US012601339B2

(12) United States Patent
Chou et al.

(10) Patent No.: US 12,601,339 B2
(45) Date of Patent: Apr. 14, 2026

(54) AIR COMPRESSOR

(71) Applicant: UNIK WORLD INDUSTRIAL CO., LTD., Tainan City (TW)

(72) Inventors: Wen San Chou, Tainan City (TW); Cheng Hsien Chou, Tainan City (TW)

(73) Assignee: UNIK WORLD INDUSTRIAL CO., LTD., Tainan City (TW)

( * ) Notice: Subject to any disclaimer, the term of this patent is extended or adjusted under 35 U.S.C. 154(b) by 110 days.

(21) Appl. No.: 18/597,918

(22) Filed: Mar. 7, 2024

(65) Prior Publication Data

US 2025/0264094 A1 Aug. 21, 2025

(30) Foreign Application Priority Data

Feb. 21, 2024 (TW) ..... 113106064

(51) Int. Cl.

| | |
|---|---|
| ***F04B 37/12*** | (2006.01) |
| ***F04B 35/00*** | (2006.01) |
| ***F04B 49/12*** | (2006.01) |
| ***F04B 53/14*** | (2006.01) |

(52) U.S. Cl.

CPC ..... *F04B 37/12* (2013.01); *F04B 35/00* (2013.01); *F04B 49/125* (2013.01); *F04B 53/14* (2013.01)

(58) Field of Classification Search

CPC ..... F04B 37/12; F04B 35/00; F04B 49/125; F04B 53/14; F04B 39/122; F04B 39/0005;

(Continued)

(56) References Cited

U.S. PATENT DOCUMENTS 6,213,725 B1 * 4/2001 Chou ..... F04B 35/04 417/415
2005/0188839 A1 * 9/2005 Inoue ..... F04B 39/042 92/187

(Continued)

FOREIGN PATENT DOCUMENTS

CN 101737296 6/2010
CN 202040046 11/2011

(Continued)

OTHER PUBLICATIONS

"Office Action of Taiwan Counterpart Application", issued on Nov. 7, 2024, p. 1-p. 4.

(Continued)

*Primary Examiner* — Mark A Laurenzi
*Assistant Examiner* — Kelsey L Stanek
(74) *Attorney, Agent, or Firm* — JCIPRNET

(57) ABSTRACT

An air compressor includes a cylinder having a piston passage having rear and front ends, a piston including piston and shaft portions, a piston ring, and a driving unit. The piston portion is in the piston passage and has an annular groove. The shaft and piston portions are connected via the rear end. The piston ring is at the annular groove. First and second portions of the piston ring are at first and second side portions of the piston portion respectively. The driving unit is coupled to the shaft portion and drives the piston portion to move back and forth between the front and rear ends via the shaft portion. A width of the annular groove at the first side portion is greater than that at the second side portion. The first portion moves along a width direction of the annular groove as the piston portion moves back and forth.

12 Claims, 8 Drawing Sheets

(58) Field of Classification Search
CPC .... F04B 39/042; F04B 39/125; F04B 39/121; F04B 39/14; F04B 35/06; F04B 35/01; F04B 35/04; F04B 53/121; F04B 53/12; F04B 53/123; F16J 9/00; F16J 15/00–56
USPC ..... 417/437; 92/172–261
See application file for complete search history.

(56) References Cited

U.S. PATENT DOCUMENTS

| | | | | |
|---|---|---|---|---|
| 2005/0191193 | A1* | 9/2005 | Chou | F04B 39/0016 417/415 |
| 2020/0132193 | A1 | 4/2020 | Scharp et al. | |
| 2022/0099077 | A1* | 3/2022 | Chen | F04B 53/14 |

FOREIGN PATENT DOCUMENTS

| | | |
|---|---|---|
| CN | 102619726 | 8/2015 |
| CN | 116857151 | 10/2023 |
| DE | 2459610 | 7/1975 |
| DE | 3706940 | 4/1988 |
| DE | 69101831 | 11/1994 |
| DE | 69105107 | 6/1995 |
| DE | 69611577 | 8/2001 |
| EP | 1437508 | 10/2006 |
| JP | H0246079 | 3/1990 |
| JP | 3094674 | 7/2003 |
| JP | 2015200310 | 11/2015 |
| JP | 3247101 | 6/2024 |
| TW | I385306 | 2/2013 |
| TW | M658134 | 7/2024 |

OTHER PUBLICATIONS

"Office Action of Germany Counterpart Application", issued on Feb. 10, 2025, p. 1-p. 8.
"Office Action of Japan Counterpart Application", issued on May 22, 2025, p. 1-p. 3.

* cited by examiner

AIR COMPRESSOR

CROSS-REFERENCE TO RELATED APPLICATION

This application claims the priority benefit of Taiwan application serial no. 113106064, filed on Feb. 21, 2024. The entirety of the above-mentioned patent application is hereby incorporated by reference herein and made a part of specification.

BACKGROUND OF THE INVENTION

Field of the Invention

The invention relates to an air compressor, and in particular to a piston air compressor.

Description of Related Art

A vehicle-mounted air compressor may be used with a tire sealant bottle to repair and inflate a tire of a vehicle, and may also be used to inflate the tire of the vehicle without a tire sealant bottle. The air compressor may be a piston air compressor. When the piston portion of the piston thereof advances in the cylinder, the piston ring around the piston portion is in contact with the inner wall of the cylinder and the space in the cylinder is gradually less as the piston portion advances. As a result, the air in the cylinder is compressed, and the check valve at the front end of the cylinder is pushed open by high-pressure air, so that the high-pressure air is output via the check valve. When the piston portion retreats in the cylinder, the space in the cylinder is gradually greater, causing the internal air pressure thereof to drop, and the piston portion is tilted due to the swing of the shaft portion of the piston, creating a gap between the piston ring and the inner wall of the cylinder. As a result, the air outside the cylinder is sucked into the cylinder from the rear end of the cylinder and compressed the next time the piston advances, thus creating a continuous cycle.

However, when the piston portion retreats in the cylinder as described above, the degree to which the piston portion is tilted due to the swing of the shaft portion is limited. Therefore, it is difficult to further increase the gap between the piston ring and the inner wall of the cylinder, and the air intake efficiency of the cylinder may not be improved.

SUMMARY OF THE INVENTION

The invention provides an air compressor having good air intake efficiency.

An air compressor of the invention includes a cylinder, a piston, a piston ring, and a driving unit. The cylinder has a piston passage. The piston passage has a rear end and a front end opposite to each other. The piston includes a piston portion and a shaft portion. The piston portion is located in the piston passage and has an annular groove, and the shaft portion is connected to the piston portion via the rear end. The piston ring is disposed at the annular groove. A first portion of the piston ring is located at a first side portion of the piston portion, and a second portion of the piston ring is located at a second side portion of the piston portion. The driving unit is coupled to the shaft portion and adapted to drive the piston portion to move back and forth between the front end and the rear end via the shaft portion. A width of the annular groove at the first side portion is greater than a width of the annular groove at the second side portion, such that the first portion of the piston ring is movable along the width direction of the annular groove as the piston portion moves back and forth.

In an embodiment of the invention, when the piston portion moves along a direction from the front end toward the rear end, a gap between the first portion of the piston ring and an inner wall of the piston passage is increased as the first portion moves along the width direction of the annular groove.

In an embodiment of the invention, the shaft portion has an eccentric shaft portion and is coupled to the driving unit via the eccentric shaft portion, and when viewed along an axial direction of the eccentric shaft portion, the first side portion and the second side portion are radially opposite two side portions of the piston portion.

In an embodiment of the invention, when the piston portion moves along a direction from the front end toward the rear end, the eccentric shaft portion and the first side portion are located at a same side of a central axis of the piston passage.

In an embodiment of the invention, the annular groove has a first inner wall and a second inner wall, the first inner wall and the second inner wall are opposite to each other in the width direction of the annular groove, the first inner wall is located between the second inner wall and the front end, and a gap between the first portion of the piston ring and an inner wall of the piston passage is increased as the first portion moves from the second inner wall toward the first inner wall.

In an embodiment of the invention, a width of the annular groove is gradually increased from the second side portion toward the first side portion.

In an embodiment of the invention, the piston portion has a top surface, the top surface faces the front end, the annular groove has a first inner wall and a second inner wall, the first inner wall and the second inner wall are opposite to each other in the width direction of the annular groove, the first inner wall is located between the second inner wall and the front end, and the first inner wall is inclined to the top surface.

In an embodiment of the invention, the second portion of the piston ring is fixed to the annular groove.

In an embodiment of the invention, the first portion of the piston ring is adapted to move along the width direction of the annular groove via a friction force between an inner wall of the piston passage and the first portion.

In an embodiment of the invention, the first portion of the piston ring is adapted to move along the width direction of the annular groove via a pressure difference between the rear end and the front end.

In an embodiment of the invention, the piston passage has a slope at the rear end, so that an inner diameter of the piston passage at the rear end is gradually increased toward an outside of the piston passage.

In an embodiment of the invention, the piston portion and the shaft portion are pivotally connected to each other.

Based on the above, in the air compressor of the invention, the annular groove of the piston portion is designed to have unequal widths at two sides. Accordingly, the piston ring has a moving space where the annular groove has a greater width. When the piston portion retreats, the gap between the piston ring and the inner wall of the piston passage may be increased via the movement of the piston ring, thereby improving the air intake efficiency of the cylinder.

DESCRIPTION OF THE EMBODIMENTS

Figure 1A:
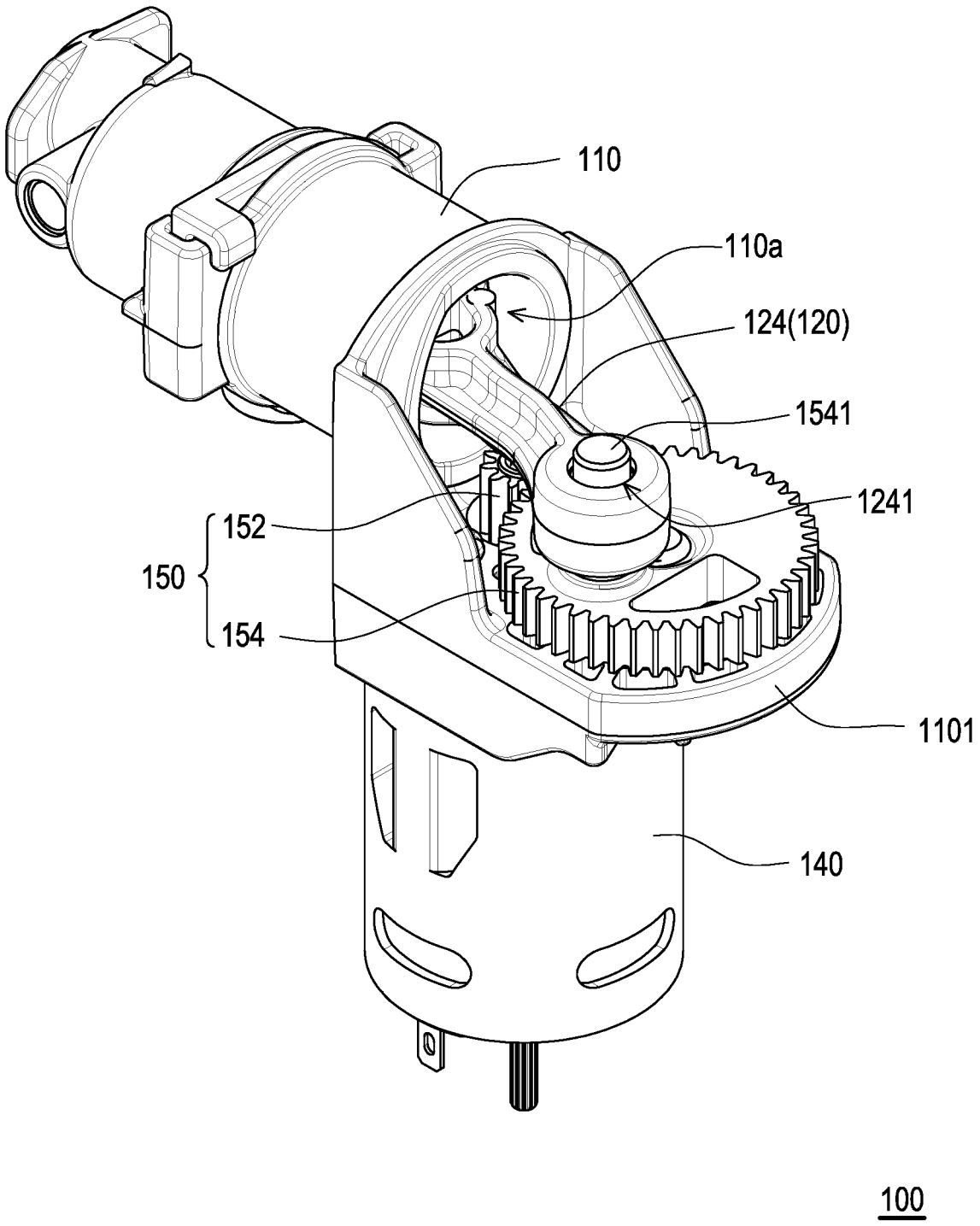
FIG. 1A and FIG. 1B respectively illustrate different operating states of an air compressor of an embodiment of the invention.
Figure 1B:
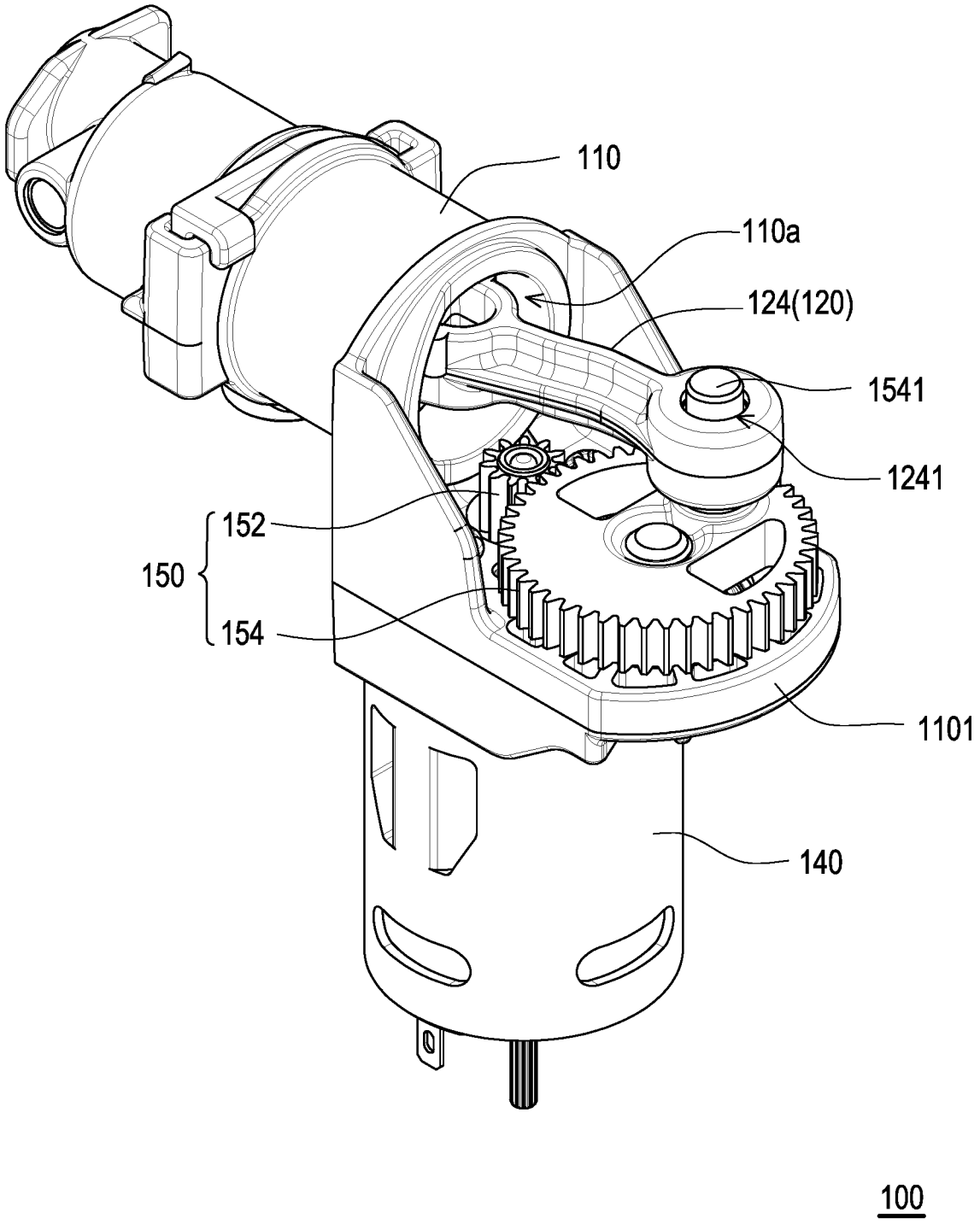
Figure 2A:
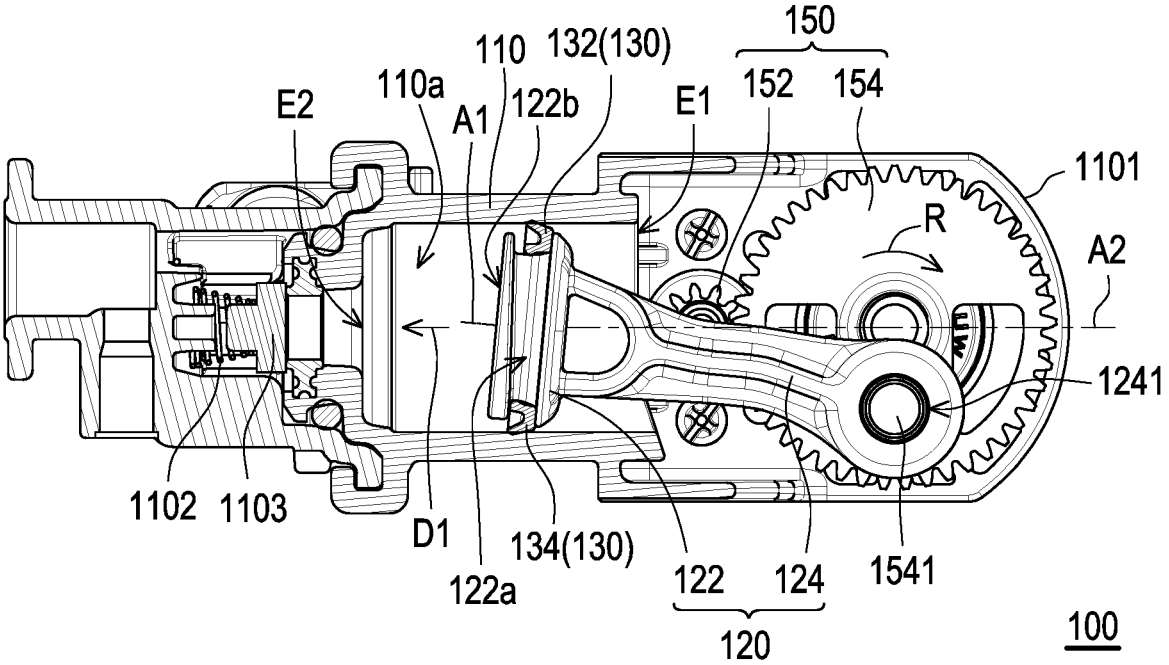
FIG. 2A and FIG. 2B are cross-sectional views of the air compressor of FIG. 1A and FIG. 1B respectively.
Figure 2B:
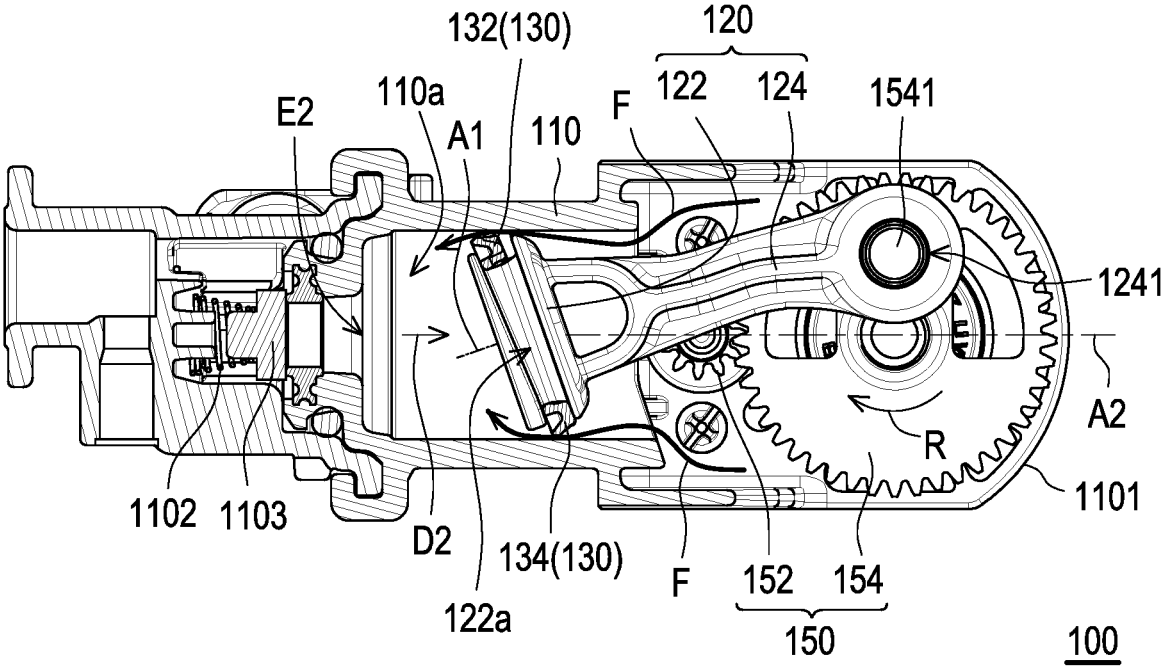

FIG. 1A and FIG. 1B respectively illustrate different operating states of an air compressor of an embodiment of the invention. FIG. 2A and FIG. 2B are cross-sectional views of the air compressor of FIG. 1A and FIG. 1B respectively. Please refer to FIG. 1A to FIG. 2B. An air compressor 100 of the present embodiment is, for example, a vehicle-mounted air compressor used to provide high-pressure air needed for inflating and/or repairing a tire of a vehicle. However, the invention is not limited thereto. The air compressor 100 includes a cylinder 110, a piston 120, a piston ring 130, and a driving unit 140. The cylinder 110 has a piston passage 110*a*, and the piston passage 110*a* has a rear end E1 and a front end E2 opposite to each other. The piston 120 includes a piston portion 122 and a shaft portion 124. The piston portion 122 is located in the piston passage 110*a* and has an annular groove 122*a*. The annular groove 122*a* surrounds a central axis A1 of the piston portion 122. The shaft portion 124 is connected to the piston portion 122 via the rear end E1 of the piston passage 110*a*. The piston ring 130 is made of, for example, rubber or other elastic sealing materials and disposed at the annular groove 122*a* of the piston portion 122 and surrounds the central axis A1 of the piston portion 122.

The driving unit 140 is, for example, a motor, and is coupled to the shaft portion 124 of the piston 120. Specifically, the air compressor 100 further includes a gear set 150. The gear set 150 is disposed on an extended housing 1101 of the cylinder 110 and includes a first gear 152 and a second gear 154. The first gear 152 is disposed coaxially with the driving unit 140 and meshes with the second gear 154, and an eccentric shaft portion 1241 (for example, an axis hole) of the shaft portion 124 is eccentric to the center of the second gear 154 and pivotally connected to a column 1541 on the second gear 154 to achieve coupling between the driving unit 140 and the shaft portion 124. Accordingly, the driving unit 140 may drive the eccentric shaft portion 1241 of the shaft portion 124 to move around the center of the second gear 154 via the gear set 150 to drive the piston portion 122 to move back and forth between the front end E2 and the rear end E1 of the piston passage 110*a* via the shaft portion 124.

In the present embodiment, the second gear 154 is driven via the driving unit 140 to rotate along a rotation direction R shown in FIG. 2A and FIG. 2B. As a result, in the operating state shown in FIG. 2A, the piston portion 122 of the piston 120 advances in the piston passage 110*a* of the cylinder 110 along a direction D1 toward the front end E2 of the piston passage 110*a*, and the piston ring 130 around the piston portion 122 is in contact with the inner wall of the piston passage 110*a* and the space in the piston passage 110*a* is gradually less as the piston portion 122 advances, so that the air in the piston passage 110*a* is compressed. When the air pressure in the piston passage 110*a* is increased sufficiently as the piston portion 122 advances, high-pressure air resists the elastic force of a check spring 1102 to push the check valve 1103 at the front end of the cylinder 110 open along the direction D1, so that the high-pressure air is output via the check valve 1103.

On the other hand, in the actuation state shown in FIG. 2B, the piston portion 122 of the piston 120 retreats in the piston passage 110*a* of the cylinder 110 along a direction D2 toward the rear end E1 of the piston passage 110*a*, the space in the piston passage 110*a* is gradually greater so that the internal air pressure thereof is dropped below one atmosphere (i.e., lower than the air pressure of the external environment), and the piston portion 122 is tilted via the swing of the shaft portion 124 of the piston 120 to create a gap between the piston ring 130 and the inner wall of the piston passage 110*a*. Therefore, an air F outside the cylinder 110 is sucked into the piston passage 110*a* from the rear end E1 of the piston passage 110*a* and compressed the next time the piston portion 122 advances, thereby continuously circulating.

Figure 3:
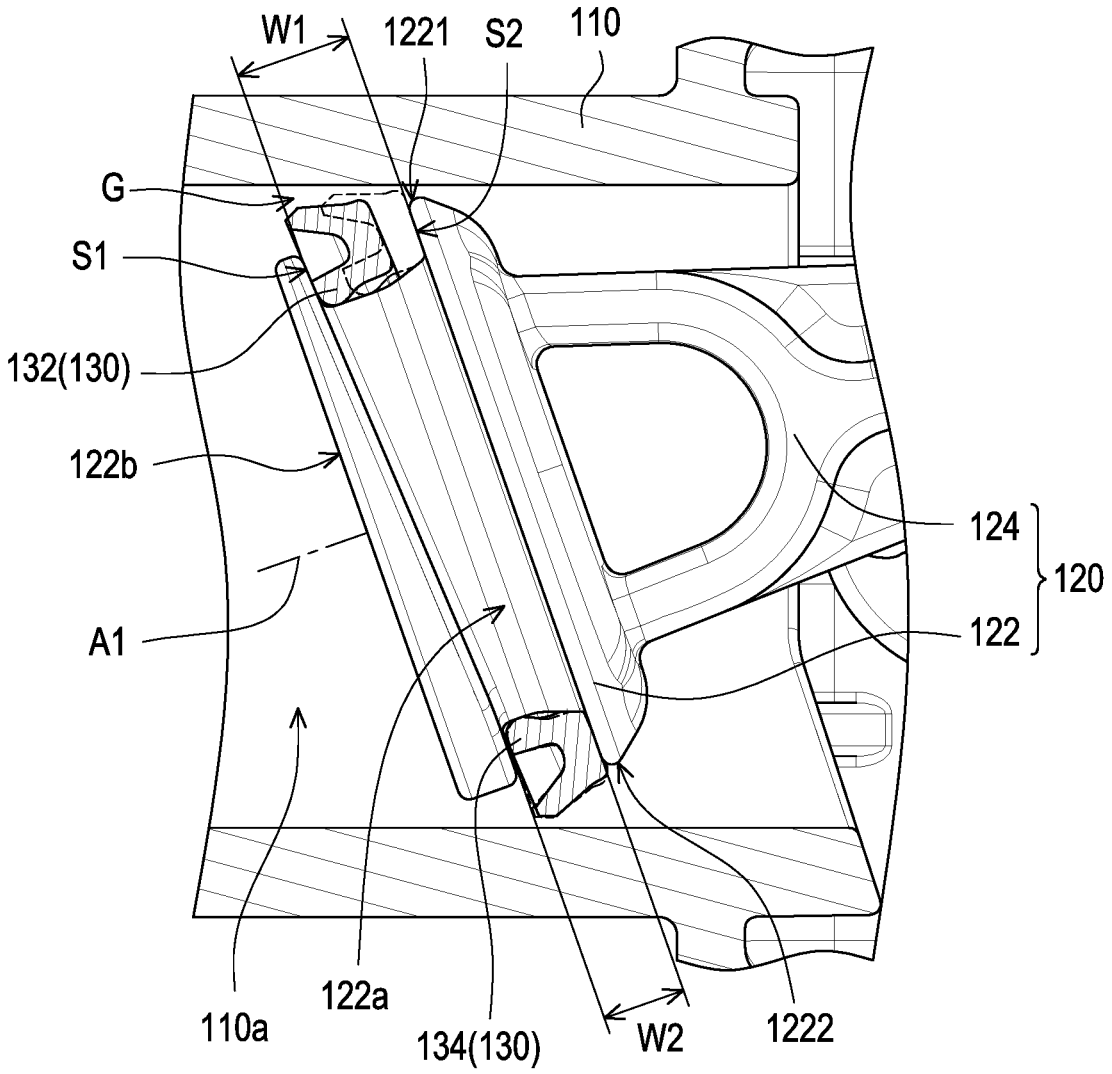
FIG. 3 is a partial enlarged view of the air compressor of FIG. 2B.

FIG. 3 is a partial enlarged view of the air compressor of FIG. 2B. Please refer to FIG. 3, the piston portion 122 has a first side portion 1221 and a second side portion 1222. When viewed along the axial direction of the eccentric shaft portion 1241 (shown in FIG. 2B), the first side portion 1221 and the second side portion 1222 are radially opposite two side portions of the piston portion 122 shown in FIG. 3. A first portion 132 of the piston ring 130 is located at the first side portion 1221 of the piston portion 122, and a second portion 134 of the piston ring 130 is located at the second side portion 1222 of the piston portion 122. A width W1 of the annular groove 122*a* at the first side portion 1221 is greater than a width W2 of the annular groove 122*a* at the second side portion 1222, such that the first portion 132 of the piston ring 130 is movable along the width direction of the annular groove 122*a* as the piston portion 122 moves back and forth. The second portion 134 of the piston ring 130 is fixed to the annular groove 122*a*, for example.

As described above, in the air compressor 100 of the present embodiment, the annular groove 122*a* of the piston portion 122 is designed to have unequal widths at two sides. Accordingly, the piston ring 130 has a moving space where the annular groove 122*a* has a greater width. When the piston portion 122 retreats, a gap G between the piston ring 130 and the inner wall of the piston passage 110*a* may be increased via the movement of the piston ring 130, thereby improving the air intake efficiency of the cylinder 110.

The structure and operation of the air compressor 100 of the present embodiment are described more clearly below.

Please refer to FIG. 3. Specifically, the annular groove 122*a* of the present embodiment has a first inner wall S1 and a second inner wall S2, the first inner wall S1 and the second inner wall S2 are opposite to each other in the width direction of the annular groove 122*a*, and the first inner wall S1 is located between the second inner wall S2 and the front end E2 (shown in FIG. 2B) of the piston passage 110*a*, and the first portion 132 of the piston ring 130 may move between the first inner wall S1 and the second inner wall S2. In addition, the piston portion 122 has a top surface 122*b*, the top surface 122*b* faces the front end E2 of the piston passage 110*a*, and the central axis A1 of the piston portion 122 is perpendicular to the top surface 122*b*. The second inner wall S2 of the annular groove 122*a* is parallel to the top surface 122*b*, and the first inner wall S1 of the annular groove 122*a* is inclined to the top surface 122*b*, so that the width of the annular groove 122*a* is gradually increased from the second side portion 1222 toward the first side portion 1221, so that the annular groove 122*a* has a greater width W1 at the first side portion 1221 as mentioned above.

When the piston portion moves along the direction D2 from the front end E2 toward the rear end E1 of the piston passage 110*a*, the eccentric shaft portion 1241 of the shaft portion 124 and the first side portion 1221 of the piston portion 122 are located at the same side of a central axis A2 of the piston passage 110*a*, so that the piston portion 122 becomes an inclined state shown in FIG. 2B and FIG. 3. As a result, when the piston portion 122 moves along the direction D2, the gap G between the first portion 132 of the piston ring 130 and the inner wall of the piston passage 110*a* is increased as the first portion 132 moves along the width direction of the annular groove 122*a* from the second inner wall S2 toward the first inner wall S1.

In the present embodiment, the first portion 132 of the piston ring 130 may be driven via the air flow and/or via the friction force between the inner wall of the piston passage 110*a* and the first portion 132 to move from the second inner wall S2 toward the first inner wall S1 as mentioned above. Specifically, when the piston portion 122 moves along the direction D2, the pressure difference between the rear end E1 and the front end E2 of the piston passage 110*a* causes the air F to flow along the direction from the rear end E1 to the front end E2. Therefore, the first portion 132 of the piston ring 130 may be driven by the air flow and move toward the first inner wall S1 of the annular groove 122*a* along the width direction of the annular groove 122*a*. Moreover, during the process of the piston 120 operating from the state of FIG. 2A to the state of FIG. 2B, when the first portion 132 of the piston ring 130 is still in contact with the inner wall of the piston passage 110*a* and the piston portion 122 starts to move along the direction D2, the friction force between the inner wall of the piston passage 110*a* and the first portion 132 may drive the first portion 132 to move toward the first inner wall S1 of the annular groove 122*a* along the width direction of the annular groove 122*a*.

Figure 4A:
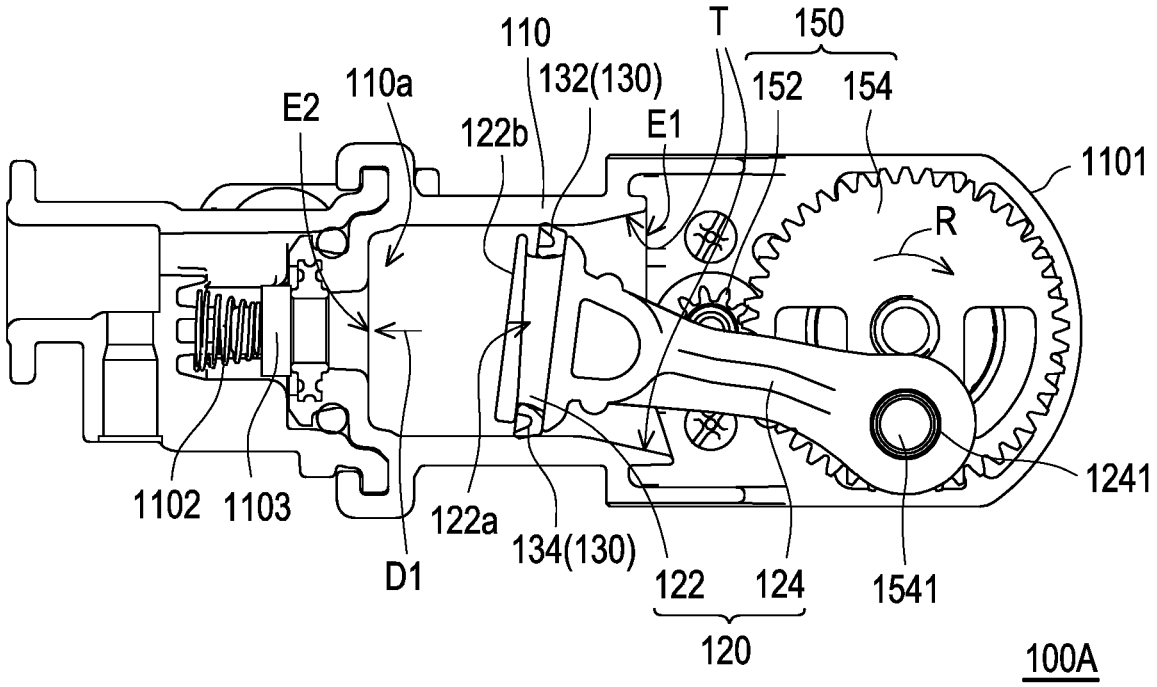
FIG. 4A to FIG. 4D are respectively cross-sectional views of an air compressor in different operating states of another embodiment of the invention.
Figure 4B:
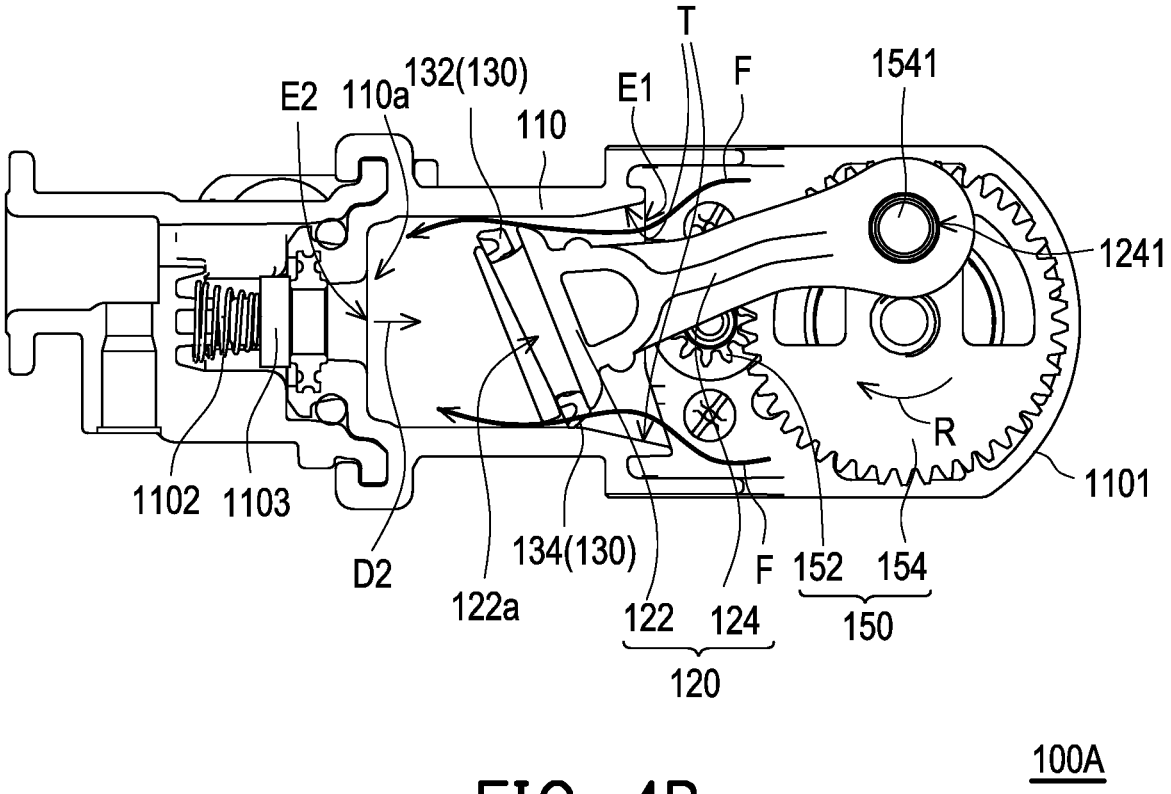
Figure 4C:
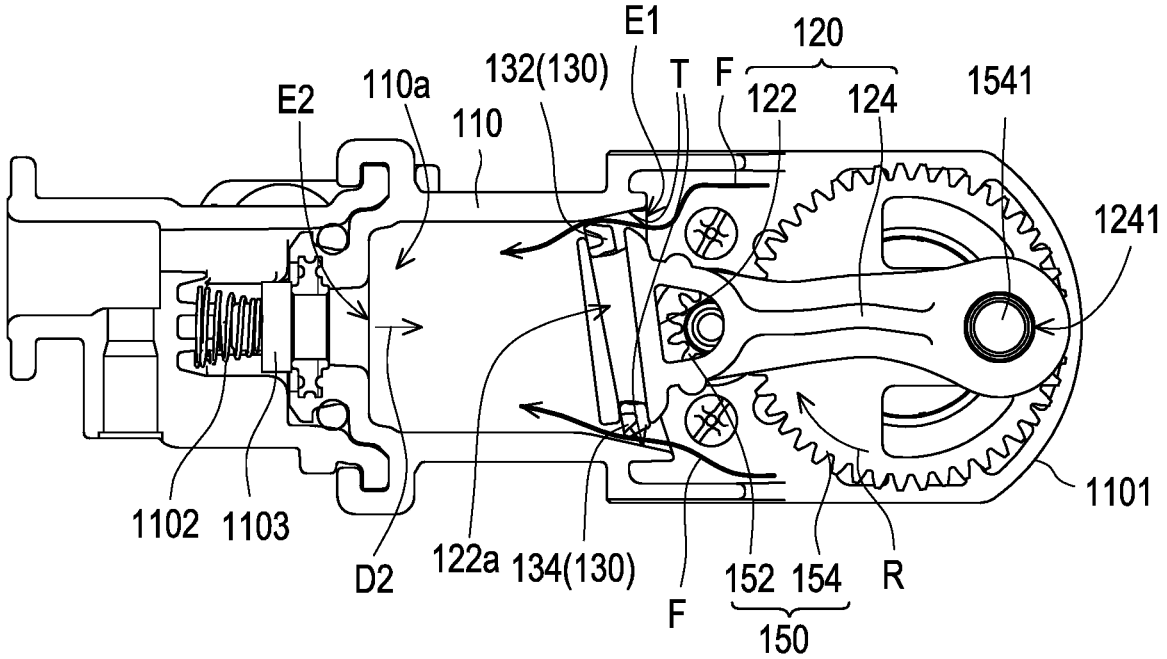
Figure 4D:
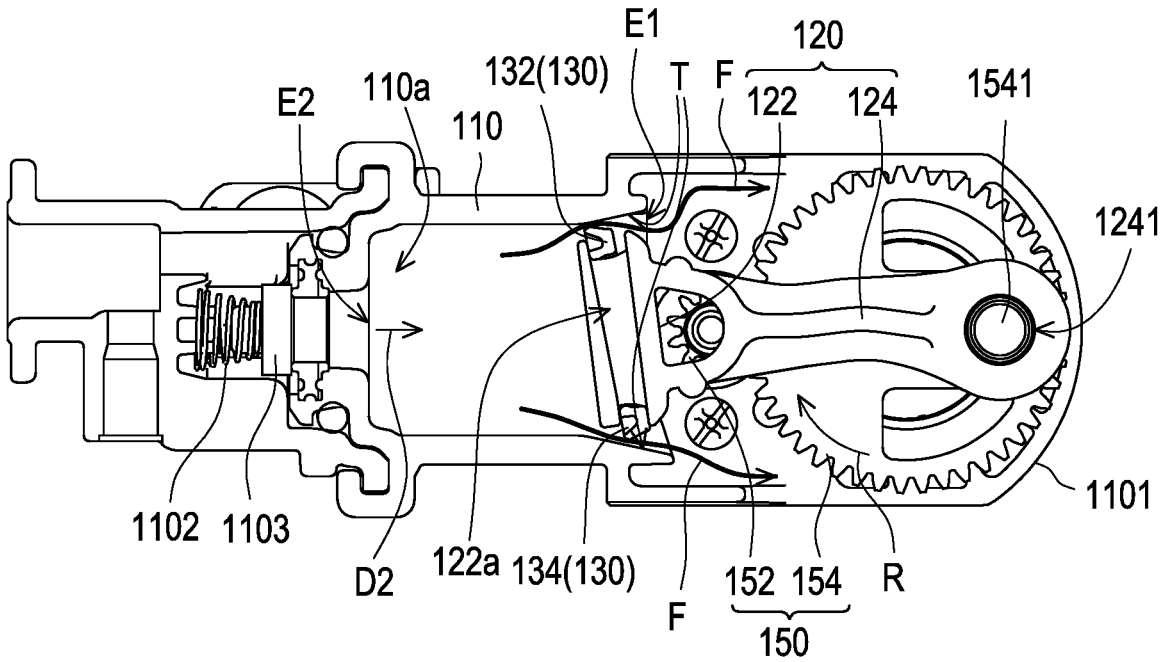

FIG. 4A to FIG. 4D are respectively cross-sectional views of an air compressor in different operating states of another embodiment of the invention. An air compressor 100A of FIG. 4A to FIG. 4D is different from the air compressor 100 of the previous embodiment in that: the piston passage 110*a* of the air compressor 100A has a slope T at the rear end E1, so that the inner diameter of the piston passage 110*a* at the rear end E1 is gradually increased toward the outside of the piston passage 110*a*. Accordingly, when the piston 120 moves along the direction D2 to the state shown in FIG. 4C, there is a gap between the slope T of the rear end E1 and the piston ring 130 of the piston passage 110*a* to further improve the air intake efficiency of the cylinder 110. In addition, the check valve 1103 at the front end of the cylinder 110 may be poorly sealed, causing the high-pressure air at the pneumatic equipment end to enter the cylinder 110 via the check valve 1103 to form a high pressure. The gap between the inclined surface T of the rear end E1 of the piston passage 110*a* and the piston ring 130 may further discharge the high-pressure air out of the cylinder 110 as shown in FIG. 4D. As a result, the piston 120, the driving unit 140, the gear set 150, etc. may be prevented from being damaged due to the impact of high-pressure air in the cylinder 110 when the piston 120 advances along the direction D1 next time. The remaining configurations and functions of the air compressor 100A of FIG. 4A to FIG. 4D are the same as or similar to the air compressor 100 in the previous embodiment, and are not described again here.

Figure 5:
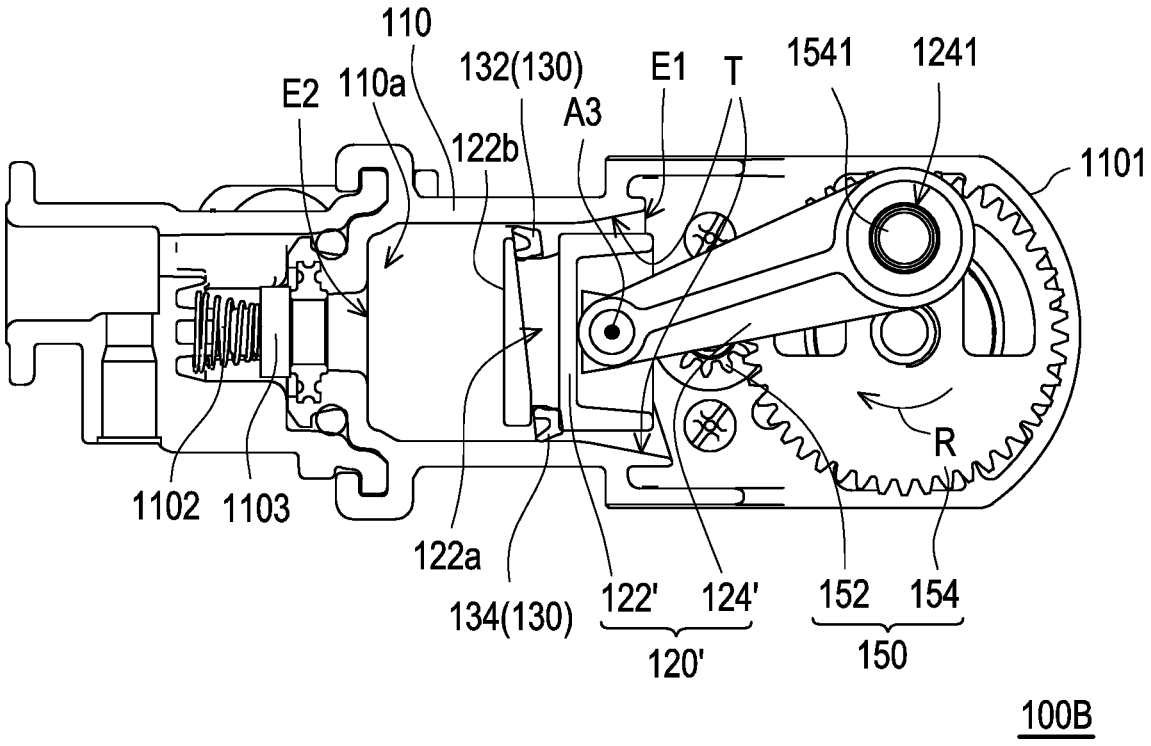
FIG. 5 is a cross-sectional view of an air compressor of another embodiment of the invention.

FIG. 5 is a cross-sectional view of an air compressor of another embodiment of the invention. The difference between an air compressor 100B of FIG. 5 and the air compressor 100A of the previous embodiment is that: a piston portion 122' and a shaft portion 124' of a piston 120' of the air compressor 100B are pivotally connected to each other along a rotation axis A3 and may be relatively rotated during the actuation process. The remaining configurations and functions of the air compressor 100B of FIG. 5 are the same as or similar to the air compressor 100A in the previous embodiment, and are not described again here.

Based on the above, in the air compressor of the invention, the annular groove of the piston portion is designed to have unequal widths at two sides. Accordingly, the piston ring has a moving space where the annular groove has a greater width. When the piston portion retreats, the gap between the piston ring and the inner wall of the piston passage may be increased via the movement of the piston ring, thereby improving the air intake efficiency of the cylinder. In addition, the piston passage may have a slope at the rear end, so that the inner diameter of the piston passage at the rear end is gradually increased toward the outside of the piston passage. Accordingly, when the piston portion actuates to the rear end of the piston passage, there is a gap between the slope at the rear end and the piston ring of the piston passage to further improve the air intake efficiency of the cylinder.

What is claimed is:

1. An air compressor, comprising:

a cylinder having a piston passage, wherein the piston passage has a rear end and a front end opposite to each other;

a piston comprising a piston portion and a shaft portion, wherein the piston portion is located in the piston passage and has an annular groove, and the shaft portion is connected to the piston portion via the rear end;

a piston ring disposed at the annular groove, wherein a first portion of the piston ring is located at a first side portion of the piston portion, and a second portion of the piston ring is located at a second side portion of the piston portion; and a driving unit coupled to the shaft portion and adapted to drive the piston portion to move back and forth between the front end and the rear end via the shaft portion, wherein a width of the annular groove at the first side portion is greater than a width of the annular groove at the second side portion, such that the first portion of the piston ring is movable along a width direction of the annular groove as the piston portion moves back and forth.

2. The air compressor of claim 1, wherein when the piston portion moves along a direction from the front end toward the rear end, a gap between the first portion of the piston ring and an inner wall of the piston passage is increased as the first portion moves along the width direction of the annular groove.

3. The air compressor of claim 1, wherein the shaft portion has an eccentric shaft portion and is coupled to the driving unit via the eccentric shaft portion, and when viewed along an axial direction of the eccentric shaft portion, the first side portion and the second side portion are radially opposite two side portions of the piston portion.

4. The air compressor of claim 3, wherein when the piston portion moves along a direction from the front end toward the rear end, the eccentric shaft portion and the first side portion are located at a same side of a central axis of the piston passage.

5. The air compressor of claim 1, wherein the annular groove has a first inner wall and a second inner wall, the first inner wall and the second inner wall are opposite to each other in the width direction of the annular groove, the first inner wall is located between the second inner wall and the front end, and a gap between the first portion of the piston ring and an inner wall of the piston passage is increased as the first portion moves from the second inner wall toward the first inner wall.

6. The air compressor of claim 1, wherein a width of the annular groove is gradually increased from the second side portion toward the first side portion.

7. The air compressor of claim 1, wherein the piston portion has a top surface, the top surface faces the front end, the annular groove has a first inner wall and a second inner wall, the first inner wall and the second inner wall are opposite to each other in the width direction of the annular groove, the first inner wall is located between the second inner wall and the front end, and the first inner wall is inclined to the top surface.

8. The air compressor of claim 1, wherein the second portion of the piston ring is fixed to the annular groove.

9. The air compressor of claim 1, wherein the first portion of the piston ring is adapted to move along the width direction of the annular groove via a friction force between an inner wall of the piston passage and the first portion.

10. The air compressor of claim 1, wherein the first portion of the piston ring is adapted to move along the width direction of the annular groove via a pressure difference between the rear end and the front end.

11. The air compressor of claim 1, wherein the piston passage has a slope at the rear end, so that an inner diameter of the piston passage at the rear end is gradually increased toward an outside of the piston passage.

12. The air compressor of claim 1, wherein the piston portion and the shaft portion are pivotally connected to each other.

* * * * *